US006554992B1

(12) United States Patent
Smith

(10) Patent No.: US 6,554,992 B1
(45) **Date of Patent: *Apr. 29, 2003**

(54) ALUMINUM ALLOY EXTERIOR COATING FOR UNDERGROUND DUCTILE IRON PIPE

(75) Inventor: W. Harry Smith, Flora, IL (US)

(73) Assignee: McWane, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/485,081

(22) Filed: Jun. 7, 1995

(51) Int. Cl.[7] ..... C23F 13/00

(52) U.S. Cl. ..... 205/732; 204/196.21; 204/196.23; 138/143; 138/145; 138/146

(58) Field of Search ..... 204/147, 148, 204/196, 197; 205/730–732

(56) References Cited

U.S. PATENT DOCUMENTS

| | | | | | |
|---|---|---|---|---|---|
| 1,867,984 | A | * | 7/1932 | Pistor | 204/197 |
| 2,491,225 | A | * | 12/1949 | Stearns | 204/196 |
| 3,260,661 | A | * | 7/1966 | Kemp et al. | 205/731 |
| 3,343,948 | A | * | 9/1967 | Raclot | 204/197 |
| 3,490,497 | A | * | 1/1970 | Kennedy | 204/197 |
| 3,623,968 | A | * | 11/1971 | Bohne | 204/197 |
| 3,625,259 | A | | 12/1971 | Kennedy et al. | |
| 3,803,012 | A | * | 4/1974 | Kurr | 204/197 |
| 3,881,880 | A | | 5/1975 | Gomersall | |
| 4,452,296 | A | | 6/1984 | Amano et al. | |
| 4,614,461 | A | * | 9/1986 | Taniguichi et al. | 204/197 |
| 4,755,224 | A | | 7/1988 | Bibber | |
| 4,783,896 | A | * | 11/1988 | Stubbe et al. | 204/197 |
| 4,869,753 | A | | 9/1989 | Jaklin | |
| 4,878,963 | A | | 11/1989 | Bibber | |
| 4,891,274 | A | | 1/1990 | Higuchi et al. | |
| 4,960,625 | A | | 10/1990 | Rosendahl | |
| 5,167,352 | A | | 12/1992 | Robbins | |
| 5,234,514 | A | | 8/1993 | Donahue et al. | |
| 5,295,669 | A | | 3/1994 | Campana | |

* cited by examiner

*Primary Examiner*—T. Tung
(74) *Attorney, Agent, or Firm*—Thorpe North & Western

(57) ABSTRACT

A corrosion resistance treatment for ductile iron pipe placed in corrosive environments provides a corrosion resistant coating from an aluminum-silicon alloy which is applied by thermal spraying or arc spraying onto the material. The alloy contains 88% aluminum and 12% silicon by weight. The aluminum provides corrosion resistance due to cathodic action and protects the pipe even when the coating is damaged. The silicon in the alloy provides greater strength to the otherwise malleable aluminum coating to resist damage to the coating during shipping, handling and installation.

15 Claims, No Drawings

ALUMINUM ALLOY EXTERIOR COATING FOR UNDERGROUND DUCTILE IRON PIPE

BACKGROUND OF THE INVENTION

1. Field of the Invention

This invention pertains to the protection of iron materials exposed to harsh environments. More specifically, this invention pertains to materials and techniques used to protect ductile iron pipe buried underground which can be damaged by the environmental conditions created by various types of corrosive soil.

2. Prior Art

Iron pipes are used in many industries for the transportation of materials. Because of the obviously wide variety of applications, iron pipes are placed in many different environments, many of which are deleterious to the condition of the pipe. Particularly harsh environments can damage the pipe sufficiently to shorten its effective lifetime and require replacement earlier than might be expected. Replacement can be costly and inconvenient both in terms of excavating the pipe and the time lost while the pipe is out of operation. Therefore, protecting the pipe from damage caused by corrosion becomes a cost effective method of reducing the risks of using and relying on pipe.

Various methods and materials have been developed to create protective coverings for pipes. A typical method for protecting pipe involves providing an aluminum coating which is applied to an iron pipe, as exemplified by U.S. Pat. Nos. 4,755,224, 4,878,963 and 3,881,880. Aluminum is typically used as a pipe coating because it is noted for its ability to resist corrosion. In these patents, a thin layer is applied to an iron pipe before installation in a harsh environment, such as in or near salt water. Many of the protective aluminum coatings and their methods of application were even developed to enable the pipe to be used in high temperature environments.

The prior art also discloses protective pipe coatings that employ alloys so as to obtain the benefits offered by a combination of materials in a protective coating. For example, U.S. Pat. Nos. 4,891,274 and 5,234,514 utilize varying amounts of silicon and several other materials to create aluminum alloys that provide varying degrees of protection, as well as other benefits that aluminum alone can not provide.

Despite the development of corrosion resistant coatings, such as those described in the above-mentioned patents, the wide variety of corrosive soils having different corrosive properties which a single underground pipe might encounter can result in a protective pipe coating being perfectly suited for protecting a pipe at one location, and yet be inadequate for a different location, thus allowing damage to occur to the pipe.

Therefore, it would be an advantage over the prior art to not only develop a single protective coating that can withstand harsh soil conditions, but also provide protection in a wide variety of different corrosive soils.

In addition, when iron pipe is handled, installed or even after being placed underground, events often transpire which cause the relatively malleable aluminum protective coating to be pierced and exposed to the environment. Therefore, it would also be an advantage over the prior art if the protection of the exposed portions of the pipe could continue even in those potions of the pipe where the coating was accidentally removed.

OBJECTS AND SUMMARY OF THE INVENTION

It is an object of the present invention to provide a corrosion resistant protective coating for ductile iron materials that can be thermally sprayed on the pipe, where the coating provides long term protection from corrosive conditions.

It is also an object of the present invention to provide a corrosion resistant protective coating for ductile iron materials that can be arc sprayed on the pipe to achieve long term protection from corrosion.

It is another object of the present invention to provide a corrosion resistant protective coating for ductile iron materials formed as a pipe and installed in harsh and corrosive underground environmental conditions.

It is yet another object of the present invention to provide a protective coating for iron materials which provides protection in a variety of different corrosive and deleterious environments.

It is still another object of the present invention to provide a protective coating for ductile iron materials comprised of an aluminum-silicon alloy that does not suffer from intercrystalline corrosion.

Yet a further object of the present invention is to provide a protective pipe covering for iron materials comprised of an aluminum-silicon alloy which does not inhibit the film-forming capacity of the aluminum in corrosive environments.

Still another object of the present invention is to provide a protective coating for iron materials which can deposit an aluminum film to cover portions of pipe where the protective coating has been damaged or removed.

These and other objects and advantages of the present invention are realized in a corrosion resistant protective coating comprised of an aluminum-silicon alloy which is thermally sprayed or arc sprayed (using an air jet) on ductile iron materials such as piping which will be exposed to various corrosive environments. The pipe does not require any special preparations, other than being in a clean and oil free condition before the coating is applied. After application of the protective coating, a bituminous material such as asphalt is applied to further protect the pipe. The protective covering provides a barrier against corrosive soils that would otherwise damage the pipe, causing the pipe to fail or require replacement earlier than expected from normal use or exposure.

These and other objects, features, advantages and alternative aspects of the present invention will become apparent to those skilled in the art from a consideration of the following detailed description.

DETAILED DESCRIPTION OF THE INVENTION

Reference will now be made to the characteristics of the protective coating and the proper method of using the present invention which enable it to provide the protection desired. Specifically, the present invention is especially useful for protecting ductile iron pipes in corrosive soil. The description below will enable one skilled in the art to make and use the invention to protect underground pipes or other iron materials requiring corrosion protection.

The present invention is directed to an aluminum-silicon alloy. In a preferential embodiment, the alloy contains by weight 88% aluminum and 12% silicon. Other embodiments of the present invention are illustrated in Table 1.

TABLE 1

| | Al (by weight) | Si (by weight) | Formulation designation |
|---|---|---|---|
| Most Preferred | not more than about 88% | not less than about 12% | A |
| Preferred | about 85–95% | about 5–15% | B |
| Somewhat Preferred | about 95–99% | about 1% | C |

Those skilled in the art will appreciate that it has been proposed that some underground pipes be protected by a zinc covering, but the zinc covering provides much less than desirable protection of the pipe than the present invention. Those skilled in the art will also appreciate that formulations including silicon concentrations as low as 1% yield added corrosion resistance, substantial toughness and overall strength to an otherwise malleable aluminum coating. Critically, the most preferred and preferred formulations A and B of Table 1 provide corrosion resistance much better than expected by those having ordinary skill in the art.

Various aluminum silicon alloys were tested to determine the best proportions for an aluminum/silicon alloy for use as a pipe coating. Through testing, Formulation A from Table 1 was shown to provide the greatest, and most unexpected, desired benefits of corrosion resistance and increased effective pipe lifetime when applied to ductile iron pipes.

The aluminum has two properties in particular which enable it to protect the ductile iron pipe, or any ductile iron material upon which the coating be applied using a thermal spray or an arc spray. The first property is that the aluminum provides corrosion resistance for a wide range of corrosive soils. For example, underground piping is often installed in water saturated environments. These wet environments create a soil having low resistivity which speeds the corrosion process. Furthermore, if salt is present in the soil such as is found in coastal areas, the resistivity of the soil is further decreased. The soil might also be acidic, having a low pH. The soil might also contain various sulfides, and have high levels of organic material which cause the soil to vary between various aerobic and anaerobic states. All of these diverse soil conditions are known to have deleterious affects on pipes, particularly ductile iron pipe.

In keeping with the present invention, varying aluminum and silicon concentrations were tested by burying coated ductile iron pipes within these various corrosive soils with only the outer surface exposed. When removed from the soil at eighteen months and thirty months, the pipes which were coated with aluminum-silicon alloy consisting essentially of 88% aluminum and 12% silicon showed no measurable corrosion pitting. It is expected that Formulation A (see Table 1) provides similarly desirable results. It is further expected that with aluminum-silicon alloy of Formulation B (see Table 1) will show some, but still acceptable amounts of, corrosion. For comparison purposes, 99%+aluminum coated pipes were also buried in the same corrosive soils. While not displaying corrosion pitting, these aluminum coated pipes showed apparent etching, a result of a corrosive reaction between the soils and the aluminum. Thus, while silicon-bearing aluminum was actually chosen for its property of providing a harder and tougher coating, the present invention also unexpectedly benefitted from increased corrosion resistance.

The second protective property recognized by the present invention is the ability of aluminum to provide cathodic protection for the material being covered. Corrosion of metal is an electrochemical process whereby corrosion results when direct current is discharged from the metal. Cathodic protection is accomplished by reversing the flow of direct current so that the metal of concern, in our case the pipe, is receiving current at all potential corrosion sites. This is accomplished by either using sacrificial metal or inducing direct current into the soil. In either case, the protected metal structure (the pipe) becomes the cathode. Anode materials which are commonly used include magnesium, zinc and aluminum. The anode is gradually depleted by the corrosion process and is designed to last for only a certain number of years, depending on conductivity of the soil and condition of the protective coating. In previously available schemes using remote anodes, electrical joint bonding is used to provide continuity across rubber gasketted pipe joints so that the protective current can be spread over more than one pipe length. Advantageously, with the aluminum coating of the present invention, there is no need for joint bonding because each pipe length is fully covered by the anodic aluminum, and thus each coated pipe acts as a single unit completely independent of other pipe lengths for the purpose of corrosion protection. Therefore, the aluminum-silicon alloy acts in the same way as the remote anode, except that the available aluminum is in much more intimate contact with the protected pipe.

The ability of aluminum to be deposited as a film of aluminum to provide cathodic protection and bond aluminum surfaces together is analogous to electroplating. The current for the process is generated by the difference in electrical potential between the aluminum coating and the iron pipe, and thus is only possible because of the close contact between the anode material (aluminum alloy) and the cathode (the pipe). It is also within the scope of the present invention to also provide a cathodic power supply (as can be devised by those skilled in the art) and the necessary connections to the pipe being protected.

The significance of cathodic protection is that if the protective coating is somehow damaged by a scrape or gouge that partially or totally uncovers a portion of the pipe underneath, the aluminum will eventually deposit an aluminum film to cover the exposed pipe as if it were a dressing sealing an open wound. While initially the exposed pipe might begin to corrode as the corrosive elements are able to reach it, the hole in the protective coating will eventually be covered as if the aluminum coating had been reapplied by electroplating.

Another important consideration of relying on cathodic protection which is not generally recognizable to those skilled in the art are the benefits which accompany the use of Formulation A (Table 1) in contrast to the results obtained using other formulations. Using Formulation A, with the highest concentration of silicon and correspondingly lowest concentration of aluminum, provides more desirable results than Formulations B or C which contain more aluminum for cathodic protection. Importantly, the distinguishing point lies in the fact that prevention of damage to the pipe does more to protect the pipe than having to rely on the cathodic process to heal pipe once it is damaged. If the pipe can be placed in the ground without scrapes and gouges through the protective alloy coating, then the cathodic process will only be required on to heal smaller injuries rather than depleting aluminum in a larger area to heal a large gouge cathodically. Formulation A gives the greatest protection for the pipe because of the tougher protective coating which its aluminum and silicon alloy provides. Advantageously, the formulations of the present invention consist essentially of aluminum and silicon and do not require any additional ingredients.

It should be noted that the effect of silicon in the varying concentrations shown in Formulations A, B and C does not enhance the cathodic process, but surprisingly, neither do the concentrations of silicon significantly hinder it. However, the added strength and resistance to gouging produced by the silicon more than compensates for any insignificant loss of cathodic protection ability. The silicon is mainly added to diminish the possibility of the creation of corrosion sites by handling or installation damage. In this aspect of the invention, Formulation A provided the most significant amount of resistance to damage by impact or gouge, while the range of concentrations of silicon in Formulation B still provide increased protection over that provided by Formulation C which did little more than increase corrosion protection, but not impact protection.

Another benefit of silicon in the alloy of the present invention is the prevention of intercrystalline corrosion (also called intergranular corrosion). This corrosion occurs along the boundaries of crystals of any metal or alloy in extremely corrosive media. The addition of even very small amounts of silicon to aluminum prevents intercrystalline corrosion.

When the aluminum-silicon alloy of Formulations A, B and C are applied to a pipe using a thermal spraying process, no special preparation of the pipe is required before the spraying. The pipe may even have casting defects such as pinholes which would normally allow corrosive material to infiltrate the pipe and quicken its deterioration. However, the pipe should be clean and free of foreign materials and oil. If not clean, the protective coating may not adequately adhere to the pipe providing the intimate contact needed to provide cathodic protection. A dirty pipe surface might also cause the protective coating to be of a substantially nonuniform thickness, thereby creating irregularities in the coating that might inhibit uniform pipe protection.

To apply the protective coating using the thermal spraying method, a TeroDynn gun was used. This system is preferred for micro-alloy delivery and utilizes oxygen, acetylene and compressed air. The pipe was warmed with an oxy-acetylene torch for removal of any moisture, dust or other impurities. This flame spray gun is designed to provide a proper oxygen-fuel gas mixture. An aluminum-silicon powder is carried by the oxygen, and then compressed air accelerates alloy particles at a discharge nozzle to at least 150 feet per second. Particle discharge velocity can be adjusted to provide various coating densities. The coating is preferably applied by slowly rotating the pipe while spraying until a layer of the aluminum-silicon alloy has been applied to a depth of approximately at least 6 mils. The uniform depth of the protective coating will ensure that the entire surface area of the pipe is protected equally.

The coating depth of at least 6 mils is preferred because such a depth has proven adequate for the salt spray exposure which coated steel pipe has been subjected to. Furthermore, 6 mils should provide sufficient sacrificial metal to give a reasonable lifetime while the cathodic process depletes the aluminum, even in heavily corrosive soils. Finally, while the surface of ductile iron pipe is very irregular due to peening of the molds, 6 mils provides enough coating to cover the depressions and high points of the iron pipe surface.

The flame spray unit has the additional effect of converting a major portion of the aluminum to oxidized (anodized) aluminum. This increases the overall ability of the coating to cathodically protect the pipe. The initial bond between the pipe and the protective coating is a mechanical bond. After approximately 96 hours, this bond becomes galvanic or chemical. While the flame spray process described above is preferred, it is most preferred that a two-wire arc spray (or air jet), as known in the industry, be utilized to increase the efficiency of the coating process.

After application of the protective coating, a bituminous material such as asphalt is preferably applied to the pipe to a thickness of at least 2 mils to further protect the pipe. The protective covering provides a further barrier against corrosive soils that might otherwise damage the pipe, causing the pipe to fail or require replacement earlier than expected from normal use or exposure. Appropriate bituminous materials, and suitable techniques for their application, can be chosen by those skilled in the art using the information provided herein.

It will be appreciated that the present invention provides a corrosion resistant protective coating for ductile iron materials that can be thermally-sprayed or arc-sprayed on the pipe and which provides protection in a variety of different corrosive and deleterious environments. Furthermore, the present invention provides the advantages of providing a coating which does not suffer from intercrystalline corrosion and acts to form an aluminum film to cover portions of pipe where the protective coating has been damaged or removed.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A method for providing corrosion protection and resistance to gouging for materials in a corrosive environment in the ground, said method comprising the steps of:

a) providing an aluminum-silicon alloy having between about 5 and 15 percent silicon;

b) providing a metallic pipe to be protected on which said aluminum-silicon alloy is to be applied;

c) applying said aluminum-silicon alloy on said pipe to be protected from corrosion and gouging;

d) applying a layer of bituminous material over the aluminum-silicon alloy; and e) placing the aluminum-silicon alloy protected pipe in a corrosive environment in the ground.

2. The method of providing corrosion protection as defined in claim 1, further comprising the step of forming a cathodic current through the pipe such that corrosion protection is provided when said alloy is damaged or gouged sufficient to expose the material beneath the aluminum-silicon alloy.

3. The method of providing corrosion protection as defined in claims 1, wherein the step of providing an aluminum-silicon alloy includes providing an alloy which does not suffer from intercrystalline corrosion.

4. The method of providing corrosion protection as defined in claim 1, wherein the step of applying said aluminum-silicon alloy comprises depositing an alloy coating sufficiently thick to allow the alloy coating to serve as a sacrificial anode when a cathodic current is passed therethrough.

5. The method of providing corrosion protection as defined in claim 4, wherein the step of applying said aluminum-silicon alloy comprises depositing said alloy to a depth of at least approximately 6 mils.

6. The method of providing corrosion protection as defined in claim 1, wherein the step of applying a bituminous layer over the aluminum-silicon alloy comprises depositing said bituminous layer to a depth of approximately 2 mils.

7. The method of providing corrosion protection as defined in claim 1, wherein the corrosive environment in which the pipe is placed consists of various corrosive soils that would otherwise corrode the pipe being protected.

8. The method of providing corrosion protection as defined in claim 1, wherein the process for applying the aluminum-silicon alloy is selected from the group consisting of thermal spraying and arc spraying.

9. The method of providing corrosion protection as defined in claim 1, wherein the step of applying said aluminum-silicon alloy on said pipe to be protected from corrosion further comprises the step of providing a galvanic bond between said alloy and the pipe to be protected.

10. The method of providing corrosion protection as defined in claim 1, wherein the aluminum-silicon alloy provides protection against the corrosive environment of low resistivity soils, acidic soils, soils with various sulfides, and anaerobic and aerobic soils.

11. The method of providing corrosion protection as defined in claim 1, wherein the aluminum-silicon alloy covering the pipe to be protected may initially have holes through which corrosion of the pipe to be protected may occur.

12. The method of providing corrosion protection as defined in claim 1, wherein the pipe to be protected may have casting flaws which prevent the aluminum-silicon alloy from completely covering the pipe to be protected.

13. A method for providing corrosion protection and resistance to gouging for materials in a corrosive environment, said method comprising the steps of:

a) providing an alloy consisting essentially of aluminum and silicon, the silicon being between 5 and 15 percent of the alloy;

b) providing a metallic material to be protected on which said aluminum-silicon alloy is to be applied;

c) applying said aluminum-silicon alloy on said material to be protected; and d) placing the aluminum-silicon alloy protected material underground.

14. A method for providing corrosion and gouging protection for materials in a corrosive environment, said method comprising the steps of:

a) providing an alloy consisting essentially of aluminum and silicon, the aluminum being between 85 and 95 percent of the alloy;

b) providing an iron pipe to be protected on which said aluminum-silicon alloy is to be applied;

c) arc spraying said aluminum-silicon alloy on said iron pipe to be protected; and d) placing the aluminum-silicon alloy protected iron pipe underground.

15. A method for providing corrosion protection and gouging resistance for materials in a corrosive environment, said method comprising the steps of:

a) providing an aluminum-silicon alloy having between 85 and 95 percent aluminum and between 5 and 15 percent silicon;

b) providing an iron pipe to be protected on which said aluminum-silicon alloy is to be applied;

c) thermal spraying said aluminum-silicon alloy on said iron pipe to be protected so as to anodize the aluminum-silicon alloy; and d) placing the aluminum-silicon alloy protected iron pipe underground.

* * * * *